US006898884B1

(12) United States Patent
Meyenberg

(10) Patent No.: US 6,898,884 B1
(45) Date of Patent: May 31, 2005

(54) POINT OF PURCHASE DISPLAY SYSTEM

(75) Inventor: Eric A. Meyenberg, Euclid, OH (US)

(73) Assignee: Darko, Inc., Twinsburg, OH (US)

( * ) Notice: Subject to any disclaimer, the term of this patent is extended or adjusted under 35 U.S.C. 154(b) by 92 days.

(21) Appl. No.: 10/279,256

(22) Filed: Oct. 25, 2002

(51) Int. Cl.[7] ..... G09F 3/16
(52) U.S. Cl. ..... 40/649; 40/654.01
(58) Field of Search ..... 40/316, 306, 649, 40/618, 620, 308, 654.01; 248/218.4, 277.3, 248/224.51

(56) References Cited

U.S. PATENT DOCUMENTS

| | | | | |
|---|---|---|---|---|
| 2,669,964 A * | 2/1954 | Wexler | | 116/324 |
| 3,029,537 A * | 4/1962 | Hopp et al. | | 40/653 |
| 5,138,784 A * | 8/1992 | Niwa | | 40/665 |
| 6,269,573 B1 * | 8/2001 | Najmi | | 40/666 |

* cited by examiner

*Primary Examiner*—Cassandra Davis
(74) *Attorney, Agent, or Firm*—Renner, Kenner, Greive, Bobak, Taylor & Weber

(57) ABSTRACT

A point of purchase retail display system for a product includes a graphic-holding and pocket portion (10) and a gripping portion (11). The portion (10) includes a pocket (20) having a cover (29) and a wall (12) having flanges (16, 17) spaced therefrom. A graphic display (57) may be received between the cover (29) and the flanges (16, 17). The wall (12) has a plurality of openings (41) therein and opposed lugs (42, 44), forming channels therebetween, are formed adjacent to the openings (41). The gripping portion (11) includes two gripping areas (54) having teeth (55) to grip the product when the gripping areas (54) are folded on a hinge (51). The gripping areas (54) also carry flanges (52) which can be received in the channels between the lugs (42, 44) to connect the portions (10, 11) and to maintain the gripping areas (54) folded on the hinge (51) and engaging the product.

13 Claims, 5 Drawing Sheets

POINT OF PURCHASE DISPLAY SYSTEM

TECHNICAL FIELD

This invention relates to a system for carrying signage associated with a product being displayed at a retail establishment. More particularly, this invention relates to such a system which is not only attached to the product but which also can hold or store information relating to the product. More specifically, this system is particularly suited for, and designed to be used in conjunction with, products that are irregular in shape having, for example, tubular components such as are found in bicycles.

BACKGROUND ART

Retail establishments most always draw attention to their merchandise by means of signage positioned on or adjacent to a product which, among other things, describes the product, its features, its price and the like. When the nature of the product permits its display on a shelf or a rack, such signage usually can take on a simple form positioned above or adjacent to the shelf or rack. Similarly, where an item is larger and positioned on the floor of the establishment, and if it takes on a somewhat regular shape having at least one flat surface, such as a television set or the like, the signage can be conveniently placed on top of that flat surface.

However, a problem arises when the product being displayed is too large to be positioned on a shelf and has no flat surface upon which to place signage. This problem is compounded if the product is irregular in shape and/or made up of unusually configured components, such as a bicycle which has a plurality of tubular and other irregularly-shaped components. Displays for a bicycle, for example, have taken on the form of wires hooked over the handlebars and extending downwardly over the front of the bicycle. A metal strip may extend between the hooks and then signage may be attached to the metal strips. Such a system is, however, cumbersome and somewhat unsightly.

An additional problem exists with these large products, such as television sets or bicycles, where one product of a particular model is on display, and the customer, in order to communicate to the cashier the identity of the model he wishes to purchase, must take a "pull ticket" from the product display and present it to the cashier. The pull ticket is then forwarded to the warehouse, and the desired product is delivered to the customer. Thus, pull tickets which identify a product must also be displayed and/or stored in the immediate vicinity of that product. Again, with a product having a flat surface, such does not present a problem, but otherwise known display systems do not adequately solve this problem.

DISCLOSURE OF THE INVENTION

It is thus an object of the present invention to provide a point of purchase retail display system which may be utilized to associate signage with a product.

It is another object of the present invention to provide a system, as above, which may be utilized with irregularly-shaped products.

It is a further object of the present invention to provide a system, as above, which can be utilized to attach signage to a product having tubular members such as a bicycle.

It is an additional object of the present invention to provide a system, as above, which can be attached to tubular members of varying sizes and shapes.

It is yet another object of the present invention to provide a system, as above, which can also be used to store pull tickets or other literature associated with the product.

These and other objects of the present invention, as well as the advantages thereof over existing prior art forms, which will become apparent from the description to follow, are accomplished by the improvements hereinafter described and claimed.

In general, a point of purchase product display system made in accordance with the present invention includes a first portion adapted to carry signage and a second portion adapted to be attached to the product. The second portion carries the first portion and the first portion maintains the attachment of the second portion to the product.

In accordance with a related aspect of the present invention, an apparatus for attaching a product to a portion of a point of purchase display system for the product includes a first gripping area and a second gripping area. A hinge connects one end of the first gripping area to one end of the second gripping area. A first flange is positioned at the other end of the first gripping area and a second flange is positioned at the other end of the gripping area. The flanges are adjacent to each other when the gripping areas are folded on the hinge so that they may be connected to the portion of the point of purchase display system.

In accordance with yet another related aspect of the present invention, an apparatus for carrying signage and adapted to be attached to a portion of a point of purchase display system that is attached to a product includes a wall having at least one opening therein. Opposed lugs are formed adjacent to the opening and are adapted to engage the portion of the point of purchase display system.

A preferred exemplary point of purchase retail display system incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
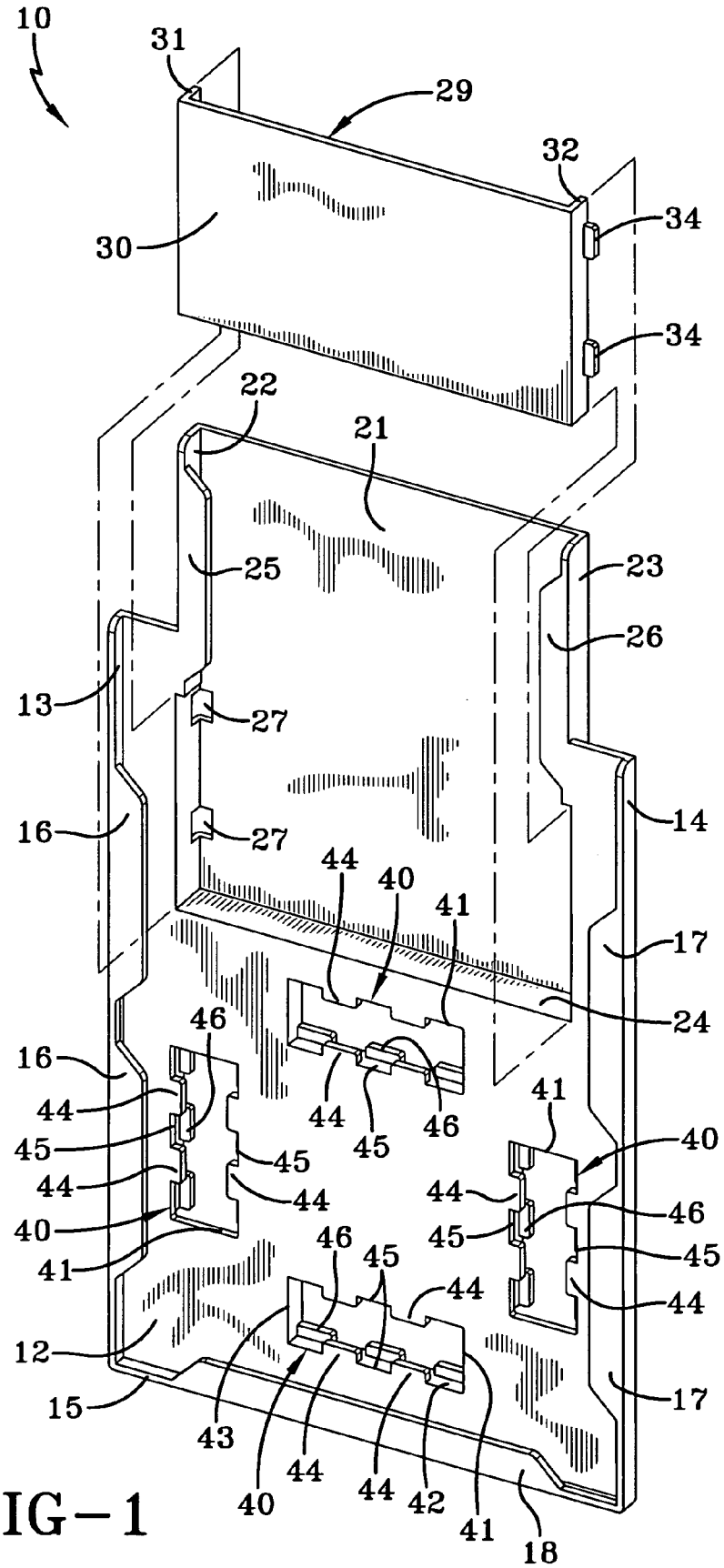
FIG. 1 is an exploded front perspective view of the graphic-holding and pocket portion of the point of purchase retail display system made in accordance with the present invention.
Figure 2:
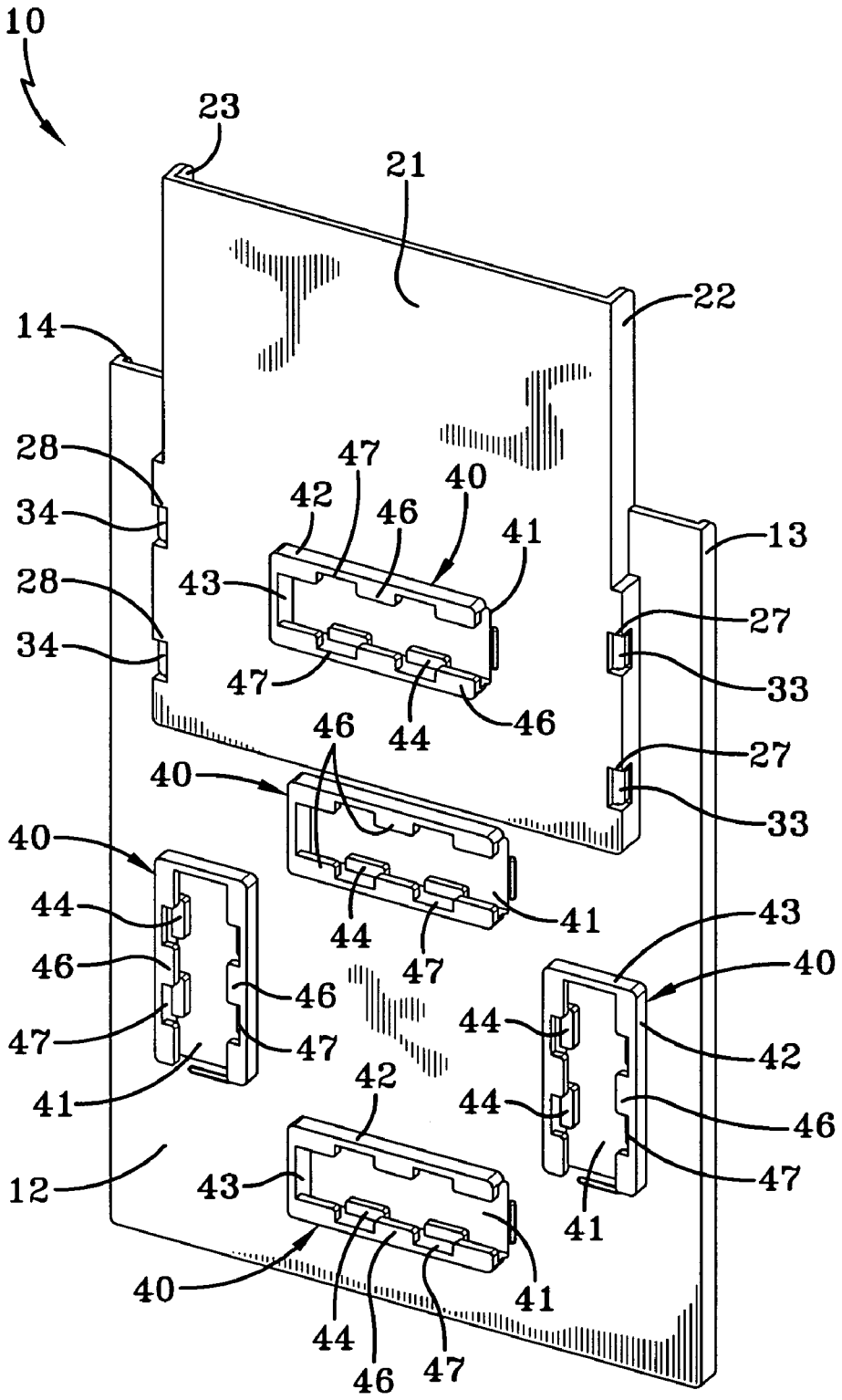
FIG. 2 is a rear perspective view of the portion of the invention shown in FIG. 1.
Figure 3:
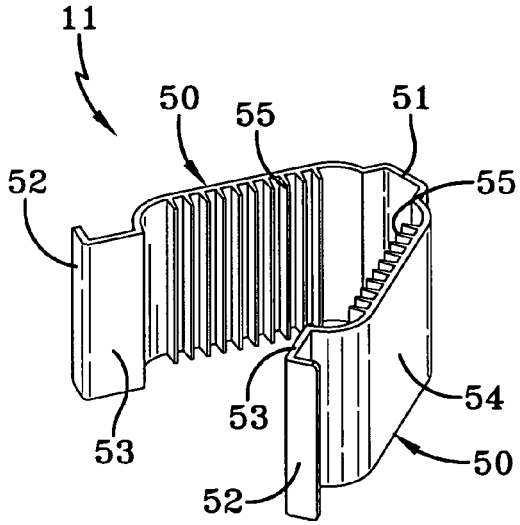
FIG. 3 is a perspective view of the product gripping portion of the point of purchase retail display system made in accordance with the present invention and showing the portion in an open condition.

The point of purchase retail display system made in accordance with the present invention includes a graphic-holding and pocket portion indicated generally by the numeral 10 and a gripping portion indicated generally by the numeral 11.

Graphic-holding and pocket portion 10 is preferably injection molded of a suitable rigid plastic material, such as polypropylene, and includes a main body or wall 12. Wall 12 is planar in nature and has opposed side edges 13 and 14 extending forwardly from the sides thereof. A bottom edge 15 similarly extends from the bottom of wall 12 and thus extends between edges 13 and 14. Flanges or tabs 16 and 17 are formed at the outer end of edges 13 and 14, respectively, and are thus spaced from and generally parallel to wall 12. Similarly, a flange or tab 18 is formed at the outer end of bottom edge 15 and is spaced from and parallel to wall 12.

Figure 8:
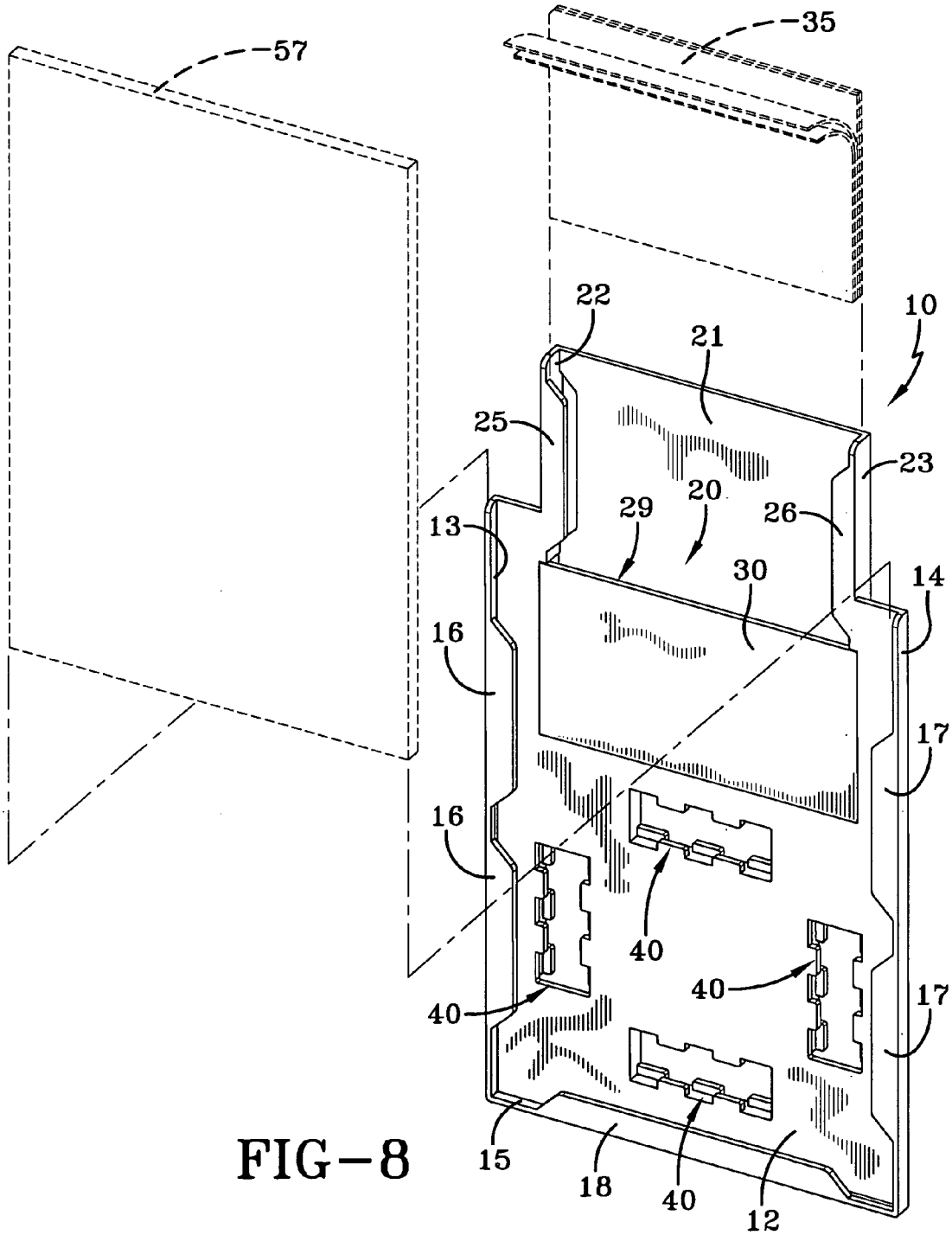
FIG. 8 is a somewhat schematic representation as to how graphic material is received by the graphic-holding and pocket portion of the present invention and how it may be utilized to hold items in the pocket thereof.

A pocket, generally indicated by the numeral 20 and best shown assembled in FIG. 8, is formed near the top of portion 10 of the display system. Pocket 20 is formed by a rear wall 21 spaced from wall 12 by side walls 22 and 23 and a bottom wall 24 extending rearwardly from wall 12. Walls 21, 22 and 23 preferably extend upwardly above the main surface of wall 12, with opposed flanges or tabs 25 and 26 being formed at the top of wall 12 and spaced from and generally parallel to rear pocket wall 21. At least one and preferably two notches 27 are formed at the junction of walls 21 and 22 and likewise, at least one and preferably two notches 28 are formed at the junction of walls 21 and 23 and are opposed to notches 27.

Pocket 20 also includes a cover generally indicated by the numeral 29. While cover 29 could be integrally formed with portion 10 of the display system, for ease of molding it is preferably, as shown, separately formed and attached to portion 10. Cover 29 includes a plate 30 having opposed flanges 31 and 32 extending from the lateral edges thereof. At least one and preferably two lugs 33 are formed on flange 31, and similarly, lugs 34 are formed on flange 32. Lugs 33 and 34 are adapted to engage notches 27 and 28, respectively, so that plate 30 is positioned generally parallel to and spaced from pocket rear wall 21. Pocket 20 is thus defined by plate 30 at the front, wall 21 at the rear, walls 22, 23 and flanges 31, 32 at the sides, and wall 24 at the bottom. As such, pocket 20 may receive and store items, such as pull tickets 35 (FIG. 8), which are associated with the particular product on display to which portion 10 is attached, as will hereinafter be more fully discussed.

Portion 10 of the display system of the present invention includes a plurality of holding systems, generally indicated by the numeral 40, which are designed to hold, or otherwise carry, a gripping portion 11 to be hereinafter described. Holding systems 40 are formed in wall 12 and rear wall 21 and, except for their orientation, systems 40 are identical, as now will be described.

Each system 40 includes a generally rectangular opening 41 formed in wall 12 and/or wall 21. Two sides and one end of each opening 41 are framed by opposed ledges 42 extending outwardly from the sides of opening 41 and by a ledge 43 extending outwardly from one end of opening 41. Each side of each opening 41 is provided with a plurality of lugs 44 which alternate with spaces 45 therebetween. It is preferable that lugs 44 on each side of opening 41 are aligned with their opposed lugs 44 and that spaces 45 are aligned with their opposed spaces 45. The outer edge of each ledge 42 is provided with a plurality of lugs 46 which alternate with spaces 47 therebetween. It is preferable that lugs 46 are aligned with their opposed lugs 46 and that spaces 47 are aligned with their opposed spaces 47. However, lugs 44 are not aligned with lugs 46 nor do spaces 45 align with spaces 47. Rather, lugs 44 are aligned with spaces 47 and lugs 46 are aligned with spaces 45. Such creates a channel defined by ledges 42 and alternating lugs 44 and 46 on each side of ledges 42. These channels are adapted to receive the gripping portion 11 now to be described.

Gripping portion 11 is formed as a strip of material having identical sides generally indicated by the numeral 50 and connected by a hinge area 51. Gripping portion 11 is preferably formed of co-extruded polyvinylchloride such that sides 50 are generally rigid and the hinge area 51 is flexible. Each side 50 includes a connection flange 52 carried by a neck 53. One end of a gripping area 54 is connected to neck 53 and extends toward and has its other end connected to hinge area 51. Thus, the gripping areas 54 of sides 50 are connected via hinge area 51. Each gripping area is provided with a plurality of gripping teeth 55 which permit the system to engage members of varying sizes.

Figure 5:
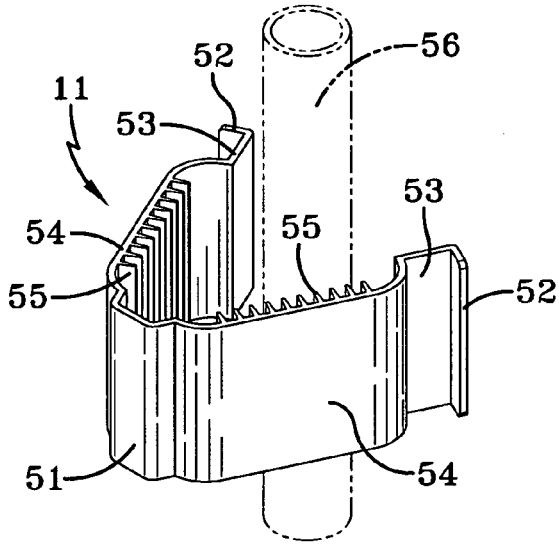
FIG. 5 is a perspective view of the portion of the invention shown in FIG. 3 showing it as it is about to engage a tubular portion of a product.
Figure 4:
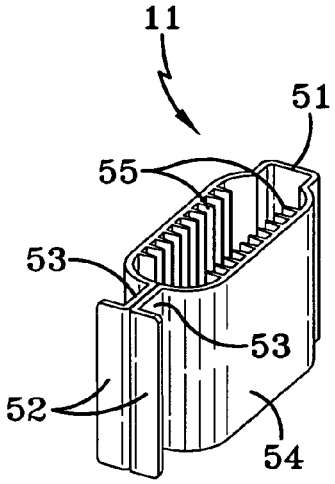
FIG. 4 is a perspective view of the portion of the invention shown in FIG. 3 showing it in a closed condition.
Figure 6:
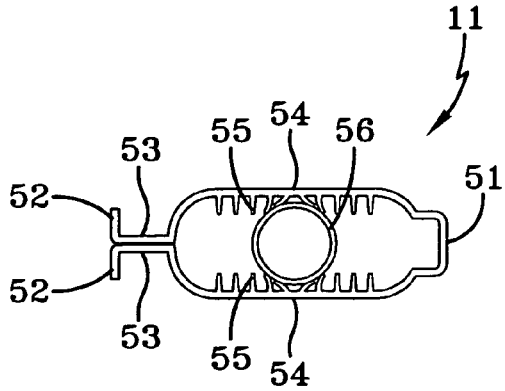
FIG. 6 is a somewhat schematic plan view showing the portion of the invention of FIG. 3 gripping a tubular portion of a product.
Figure 7:
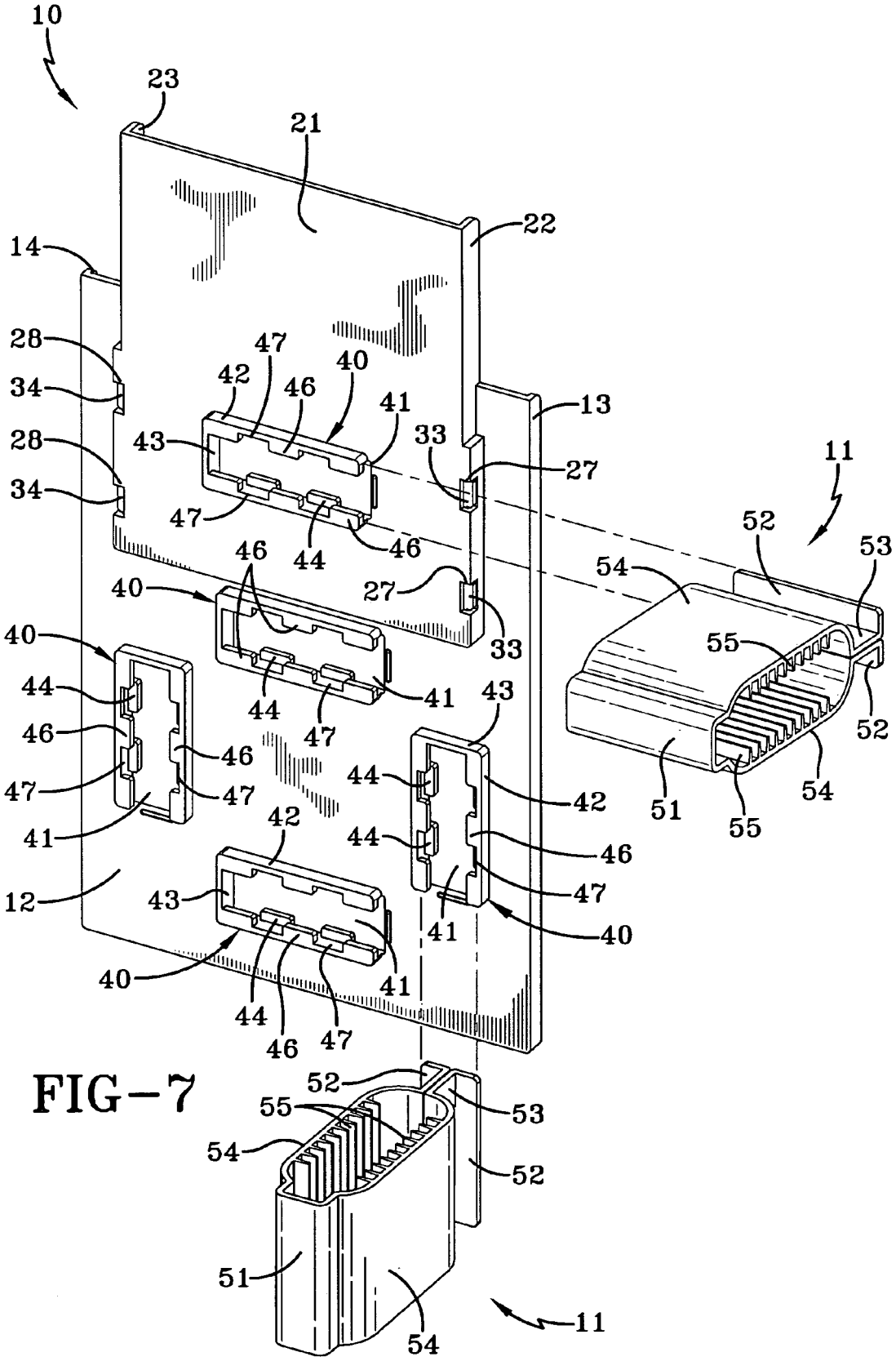
FIG. 7 is an exploded perspective view showing alternative manners by which the gripping portion of the present invention may be received by the graphic-holding and pocket portion of the present invention.

As shown in FIGS. 5 and 6, gripping portion 11 is particularly suited to engage a tubular member 56 such as might be found on a bicycle or similar product. While tubular member 56 is being shown as being cylindrical in nature, it should be evident that gripping portion 11 could well engage a member of square or other configuration. The tubular member 56 is engaged by folding the sides 50 on hinge 51 until necks 53 contact each other, as shown in FIG. 6. At that time, tubular member 56 will be engaged by teeth 55. Then, as shown in FIG. 7, a gripping portion 11 may be positioned in a selected holding system 40 by sliding the flanges 52 into the opposed channels defined by ledges 42 and alternating lugs 44 and 46, as previously described, until flanges 52 engage end ledge 43. It should be evident that when flanges 52 are engaged in the channel, gripping portion 11 will be maintained in the closed position shown in FIGS. 4 and 6. Thus, portion 10 maintains portion 11 engaging the item on retail display.

As a result, graphic-holding and pocket portion 10 is carried by tubular member 56 via gripping portion 11. It should be noted that because a plurality of holding systems 40 are provided, portion 10 can be positioned relative to tubular member 56 at various relative locations and orientations. For example, there are three systems 40 shown wherein the channels are horizontally oriented. If one of those systems 40 is selected to be utilized, such will result in portion 10 being horizontally oriented relative to the tubular member 56 with pocket 20 thereby being on a side instead of at the top as shown in the drawings. The lateral location of portion 10 relative to tubular member 56 may be established dependent upon which of the three horizontally oriented systems 40 are selected to hold gripping portion 11.

Two vertically oriented systems 40 are shown and, if selected to engage gripping portion 11, such will result in portion 10 being vertically oriented (with pocket 20 at the top) relative to tubular member 56. The lateral positioning of portion 10 relative to tubular member 56 may be established dependent on which of the two vertically oriented systems 40 are selected.

It should thus be evident that the present invention provides the retailer with a wide selection of signage positioning. First, the desired tubular member of a product to be engaged by gripping portion 11 is selected and then the desired horizontal/vertical, left/right positioning of portion 10 is determined by selecting the appropriate holding system 40 to receive gripping portion 11. Of course, while two horizontally oriented and three vertically oriented options are shown, any reasonable number of systems 40 may be provided.

Whatever the orientation of portion 10, as shown in FIG. 8, it may carry a graphic display 57. Display 57 is inserted by sliding it downward between cover plate 30 and flanges 16 and 17 until it reaches the bottom where it is additionally supported by flange 18. As such, information unique to the product to which the system is attached can be displayed. In addition, as previously discussed, when a customer has decided to purchase the product, a pull ticket 35 may be removed from pocket 20 and taken to the cashier of the establishment for processing. Of course, any other information about the product being displayed could also be stored in pocket 20.

It should be appreciated that the retail display system of the present invention is interchangeably useable with a wide variety of products. For example, all one needs to do is remove gripping portion 11 from its holding system 40, change the signage and related materials, and transfer the device to a different product being displayed.

It should thus be evident that a retail display system as discussed herein accomplishes the objects of the present invention and otherwise substantially improves the art.

What is claimed is:

1. A point of purchase display system for a product comprising a first portion adapted to carry signage, and a second portion adapted to be attached to the product, said second portion carrying said first portion and said first portion maintaining the attachment of said second portion to the product, said first portion including a plurality of holding systems for engaging said second portion, said holding systems being oriented in at least two different positions so that said first portion can selectively be carried at different orientations relative to the product.

2. The display system of claim 1 wherein said second portion includes two gripping areas separated by a hinge.

3. The display system of claim 2 further comprising teeth on said gripping areas adapted to engage the product when said gripping areas are folded on said hinge.

4. The display system of claim 2 further comprising a flange carried by each said gripping area, said flanges communicating with each other when said gripping areas are folded on said hinge.

5. The display system of claim 4 wherein said first portion engages said flanges to maintain said gripping areas folded on said hinge.

6. The display system of claim 1 wherein said first portion includes a wall and said holding system includes an opening in said wall.

7. The display system of claim 6 wherein opposed ledges are formed on sides of said opening and first lugs are formed on each side of said opening and second lugs are formed on each edge of said ledge, channels being formed between said first and second lugs.

8. The display system of claim 7 wherein said second portion includes a first flange receivable in one channel and a second flange receivable in the other channels.

9. The display system of claim 8 wherein said second portion includes a first gripping area carrying said first flange and a second gripping area carrying said second flange, said gripping areas being connected by a hinge so that said flanges communicate with each other when said gripping areas are folded on said hinge.

10. The display system of claim 1 wherein said first portion includes a wall and flanges carried by and having a portion spaced from said wall, the signage being adapted to be received in the space between said wall and said flanges.

11. The display system of claim 1 wherein said first portion includes a pocket formed by a cover positioned adjacent to said wall, the signage being adapted to be received between said cover and said flanges.

12. A point of purchase display system comprising a first portion adapted to carry signage, a second portion adapted to be attached to the product, said second portion carrying said first portion, a pocket, said pocket being formed by a back wall, side walls and a bottom wall formed in said first portion, said back wall and said side walls having notches formed at the junction thereof, a cover forming the front wall of said pocket, and lugs carried by said cover to be received in said notches to attach said cover to said first portion.

13. Apparatus for attaching a product to a portion of a point of purchase display system for the product comprising a first gripping area, a second gripping area, a hinge connecting one end of said first gripping area to one end of said second gripping area, a first flange at the other end of said first gripping area, and a second flange at the other end of said second gripping area, said first and second flanges being adjacent to each other when said gripping areas are folded on said hinge, the portion of the point of purchase display system including a wall, at least one opening in said wall, lugs associated with said opening and forming channels therebetween, said flanges being received in said channels so that said gripping areas are maintained folded on said hinge.

* * * * *